US007703771B2

(12) United States Patent
Hunt et al.

(10) Patent No.: US 7,703,771 B2
(45) Date of Patent: Apr. 27, 2010

(54) TETHERED BALL TOSS AND TARGET GAME AND METHOD OF PLAYING SAME

(76) Inventors: Ray M Hunt, 1808 Immel Rd., Chewelah, WA (US) 99109-9700; Anne Hunt, 1808 Immel Rd., Chewelah, WA (US) 99109-9700

( * ) Notice: Subject to any disclaimer, the term of this patent is extended or adjusted under 35 U.S.C. 154(b) by 919 days.

(21) Appl. No.: 11/406,681

(22) Filed: Apr. 19, 2006

(65) Prior Publication Data

US 2007/0246886 A1 Oct. 25, 2007

(51) Int. Cl.
*A63B 63/00* (2006.01)

(52) U.S. Cl. ..... 273/343

(58) Field of Classification Search ..... 273/343, 273/407

See application file for complete search history.

(56) References Cited

U.S. PATENT DOCUMENTS

| | | | | |
|---|---|---|---|---|
| 4,487,419 | A | 12/1984 | Welbourn | |
| 4,936,590 | A | 6/1990 | Palmer | |
| 4,938,485 | A | 7/1990 | Hickridge et al. | |
| 4,989,880 | A | 2/1991 | Gettemeier et al. | |
| 5,165,694 | A | 11/1992 | Kraushaar | |
| 5,230,650 | A | 7/1993 | Brayton | |
| 6,308,956 | B1 | 10/2001 | Reid | |
| 6,773,014 | B2 * | 8/2004 | Lynch | 273/343 |
| 6,773,015 | B2 | 8/2004 | Long et al. | |
| 6,889,982 | B1 * | 5/2005 | Gove | 273/343 |
| 7,004,468 | B2 * | 2/2006 | Johnson et al. | 273/343 |
| 7,134,661 | B2 * | 11/2006 | Trecartin | 273/343 |
| 7,198,273 | B1 * | 4/2007 | Advocate | 273/343 |
| 7,328,902 | B1 * | 2/2008 | White et al. | 273/343 |
| 7,377,516 | B2 * | 5/2008 | Vallee et al. | 273/343 |
| 2003/0098545 | A1 * | 5/2003 | Webb | 273/343 |
| 2007/0045964 | A1 * | 3/2007 | Petras | 273/317 |
| 2007/0246886 | A1 * | 10/2007 | Hunt et al. | 273/343 |

OTHER PUBLICATIONS

Jun. 2005 "Highways" magazine, p. 88.

* cited by examiner

*Primary Examiner*—Raleigh W. Chiu
(74) *Attorney, Agent, or Firm*—Raymond M. Galasso; Galasso & Associates, L.P.

(57) ABSTRACT

A game in which two spherical balls tethered to opposing ends of a flexible cord are tossed at a ladder-like target goal post having a plurality of cross bars, the toss occurring from the region behind a facing goal post spaced across a field of play. An objective of the game is to toss the tethered ball pair across the field to the opposing goal post to entwine or wrap around a goal post cross bar. Points are earned when the toss remains wrapped to the crossbar.

6 Claims, 7 Drawing Sheets

TETHERED BALL TOSS AND TARGET GAME AND METHOD OF PLAYING SAME

FIELD OF THE DISCLOSURE

The disclosures made herein relate generally to the field of toss and target games where an article is tossed or thrown towards a target to score points, and more particularly the subject inventive disclosure is to a game in which a pair of balls which are tethered to a length of cord are tossed to a goal post having a plurality of target crossbars extending between two spaced vertical side rails. Points are scored when the tethered ball pair wraps around a crossbar.

BACKGROUND

Various forms of projectile toss or throw to a target type games are known. Traditional toss to a target type games such as horseshoes and various ring toss type games are well known and widely enjoyed. The prior art has several variations of article toss games utilizing an elongated dart-like member, some having a weighted tip with a spike for embedding into the ground. Over time such dart toss type games have been found to be dangerous as have been the cause of bodily injury to children and adults when an unfortunate individual is struck by a misguided hurled projectile.

Horseshoes is another example of a toss to a target game in which an iron or steel horseshoe is tossed through the air over a distance towards a pole embedded into the ground; and is also known to have significant safety issues.

An advantage of such projectile toss games as discussed above is that they are easy to learn and can even be enjoyed by people who may not be experienced with the game. Such challenging but easy to learn games are a great group entertainment medium for social and family gatherings.

Therefore, a new variety of a projectile toss and target game, one which utilizes a tethered set of rubber balls which are tossed to a target in a prescribed fashion, one which is easy to learn and can be enjoyed by a diverse age group of the population, one which avoids the safety issues of earlier article toss games as discussed above, a new variety of game providing equipment variations enabling the game to be played indoors as well as in the backyard of a residence or in tournament play, such a game would be useful and novel.

SUMMARY OF THE DISCLOSURE

Accordingly, embodiments of the inventive disclosures made herein comprise various embodiments of a projectile toss and target game, and the method of game play.

Embodiments of the inventive disclosures herein relate generally to projectile toss to a target games in which the tossed article or projectile comprises a pair of resilient spherical balls secured or tethered to opposing ends of a flexible cord of a fixed length. For a specific embodiment the balls share uniform size and weight, and taken together with the fixed cord length, provides a set of substantially uniform projectiles. A pair of spherical balls tethered to opposite ends of a cord is referred to as a bola, and various embodiments of the game presented in the inventive disclosures made herein can be referred to generically by the name of the tethered ball pair or bola. The term bola is based on the primitive weapon also called bolos (Spanish: "balls"; from boleadoras), South American Indian weapon, primarily used for hunting, consisting of stone balls, usually in a group of three, attached to long, slender ropes. In hunting rhea, guanaco, and other animals in open country, the bola is whirled like a sling, then thrown parallel to the ground to entwine the quarry's legs. The game projectile tethered ball pairs when tossed to the target bear a resemblance to the bolos. In the game according to the subject inventive disclosure the target comprises a goal post structure having two or more spaced apart vertically oriented side rails having one of more crossbars spanning between the side rails. An objective of the game is to toss the tethered ball pair to entwine or wrap around a goal post member, normally a crossbar. Where multiple crossbars are used, the cross rails are secured to the side rails in a vertically spaced arrangement with each cross rail assigned a score point value. Points are earned when a toss results in a tethered ball pair wrapping around a crossbar and remaining in place on the cross bar.

The goal post target when provided with a plurality of vertically spaced substantially horizontal crossbar members takes on the general appearance of a ladder-like structure. Goal post targets are set up a prescribed distance apart on opposite sides of a field of play. The goal posts are arranged in a facing relationship, somewhat analogous to the positioning of goal posts say on a football field. The field of play between the goal posts should be clear with no obstructions between them. The game is intended for play by two players or teams of players, although a variation of the game can be played by a single player for practice or general enjoyment and relaxation. Colored bolas are provided to each player or team, the colors differentiating the bolas tossed by each team.

The following discussion is directed to the rules and method of game play for the tethered ball toss game of the inventive disclosures herein.

The object of the game is to out score your opponent and reach 21 points by throwing bolas onto the lateral rungs or crossbars of the goal posts. The game is played in rounds. A round consists of two opposing players throwing two bolas each towards the same target goal post. A foul line is defined as an imaginary line extending in the plane of and outwards from either side of the goal post. Conditions for a foul call on a toss are:

(1) Game rules require when the bola toss is executed that at least one foot must be over the foul line, outside the playing field region between the facing goal posts. If both feet are inside the foul line during the toss, that is a foul and can not score.

(2) Additionally, a foul occurs when the bola is thrown in an illegal manner. Illegal throws include: over-handed, sidearm, and throws by the cord other than by grasping one ball and letting the other ball swing free. The bola toss can not score with the commission of a foul.

The game may be played with singles or doubles. Singles are two opposing players at the same goal post. Doubles are two person teams, four players total, with two opposing players at each goal post.

The general rules of the game are simple. The bola must be thrown by grasping only one ball while the opposing ball hangs or swings free and is then thrown to the goal post underhanded, much like pitching a softball or tossing a horseshoe. A player must have at least one foot behind the foul line when throwing the bola. If the bola contacts the ground, it is still a legal throw and the bola may bounce and entwine on a goal post crossbar and score points. In cases where a team or side consists of only one person, or single, the single person must throw two bolas, one at a time in succession in each round. Doubles (teams or sides with two players) must throw two bolas, one at a time in succession in every other round. The game or the first round is typically started by a coin toss to determine which side plays or tosses first. Subsequent rounds are started by the player or team which scored the highest score in the previous round. For a toss to score, the bola must remain attached to the goal post at the end of the round. Scores are gathered and totaled at the end of the round. The team or player that scores the highest, 21 points of more at the end of the final round, is declared the winner. In the event of a tie score, additional round or rounds are played until the tie is broken, the higher score winning.

The objective is to out score your opponent and reach 21 points by throwing bolas onto the crossbars of the goal posts. In the preferred embodiments of this disclosure where goal posts have 3 crossbars or rungs, the bottom rung earns one point, the middle rung earns two points, and the top rung earns three points.

In the case of a tournament play, the rules above are modified as follows. The 21 point score defining the winner and final round is eliminated. In the case of singles, singles play a ten round game and the high score wins. In the case of doubles, doubles play a 20 round game and the high score wins. All doubles players play either odd number or even number rounds, but never both. Thus, in doubles, each player plays ten rounds.

The following discussion is directed to embodiments of the tethered ball toss game of the subject inventive disclosure.

In a first and at least one embodiment of the inventive disclosures made herein is directed to a tethered projectile toss and target game comprising two substantially vertical goals posts serving as targets. The goal posts are spaced apart on a playing field by a pre-defined distance. Each goal post comprises a plurality of vertical distally spaced side rails wherein two of the side rails form the side edges of the goal post. The goal post further comprises a plurality of crossbars extending between the side rails. The crossbars are positioned to be substantially horizontal. The cross bars are arranged in a vertically spaced relationship with opposing ends of the crossbars secured to the goal posts. For use in playing the game a plurality of tethered projectiles are provided. The tethered projectiles are used by game players to toss towards the opposing goal post with the object of entangling the bola around members of the goal posts. Each projectile comprises a flexible cord having two ends and two spherical balls, each ball secured at opposing ends of the cord, the cord and two spheres forming the game play object bola. To support the goal posts a removable support means for holding the goal posting in a vertical position is provided. As discussed in detail above, the game is played by one or more players or team of players, wherein the game is played in rounds, wherein each player tosses one or more tethered projectiles towards the target in a round with a goal of hanging or wrapping the tethered projectiles on a crossbar, wherein each crossbar is assigned a point score, wherein the player scores points according to the crossbar entwined by the projectile in the toss, wherein game play proceeds until a defined number high score is reached or until a defined number of rounds have taken place.

In another embodiment of the inventive disclosures made herein, the first embodiment is modified such that the removable support means additionally comprises a rigid rod having a bottom end for driving into the ground and a top end removably insertable over a distance into the bottom of each side rail. The rod size and length is selected to support the goal post in a vertical position during game play.

In yet another embodiment of the inventive disclosures made herein, the first embodiment is modified such that the side rails consist of tubular side rails having an alignment notch through sidewalls at a bottom portion of the side rail. In this embodiment the removable support means comprises an elongated goal post support shoe having a side rail receiving hole on the top face of the shoe. An alignment locking hole is provided on a side of the shoe, the hole extending directly and linearly through the opposing sides of the shoe. The goal post side rails are provided with alignment notches on the bottom portion of the side rails, the alignment locking notch positioned to be alignable with the hole in the shoe sidewalls when the side rail is installed into the sidewall receiving hole in the support shoe. The length of the support shoe selected so as to support the goal post in a vertical position during game play. The alignment locking pin is sized and fitted to be removably received through the alignment locking notch in the side rail and alignment hole in the support shoe. The bottom of the support shoe is provided with one or more anti-skid rubber pads secured thereto. The anti-skid pads increase the friction between the support shoes and the surface on which they rest, particularly when placed up a hard surface or floor for game play.

In another set of embodiments of the inventive disclosures made herein, the above embodiments are modified to limit each goal post to having two vertical side rails disposed on opposite side edges of the goal post. Each goal post is provided with three crossbars consisting of a top, middle and bottom crossbar. The substantially horizontal crossbars are spaced and secured at a pre-defined separation distance vertically to the goal post side rails. The side rails and cross bars forming a substantially co-planar ladder like goal post structure.

In another embodiment of the inventive disclosures made herein, the side rails and top cross bar of the goal post are formed from an elongated metallic tubular member that is bent or formed into a 'U' shape. The 'U' shaped tubular member forms the side rails and top cross bar of the goal post. Remaining cross bars are metallic and are secured to the side rails by a welding process.

It is an objective of the inventive disclosure made herein to provide a projectile toss game which is can be played by players of all ages.

It is another objective of the inventive disclosure made herein to projectile toss game that is safer to play and provides a reduced chance of bodily injury when compared to the winged dart projectile games and the iron or steel horseshoe games and other varieties of projectile toss games.

It is an objective of the inventive disclosure made herein to projectile toss game which is easy to learn and understand such that inexperienced players can quickly participate and have fun.

It is an objective of the inventive disclosure made herein to projectile toss game which forms an enjoyable and relationship building focus for social and family gatherings.

These and other objects of the invention made herein will become readily apparent upon further review of the following specification and associated drawings.

BRIEF DESCRIPTION OF THE DRAWINGS

The drawings show a form of the invention that is presently preferred; however, the invention is not limited to the precise arrangement shown in the drawings.

DETAILED DESCRIPTION OF THE DRAWINGS

In preparation for explaining the details of the present inventive disclosure, it is to be understood by the reader that the invention is not limited to the presented details of the construction, materials and embodiments as illustrated in the accompanying drawings, as the invention concepts are clearly capable of other embodiments and of being practiced and realized in various ways by applying the disclosure presented herein.

Figure 1:
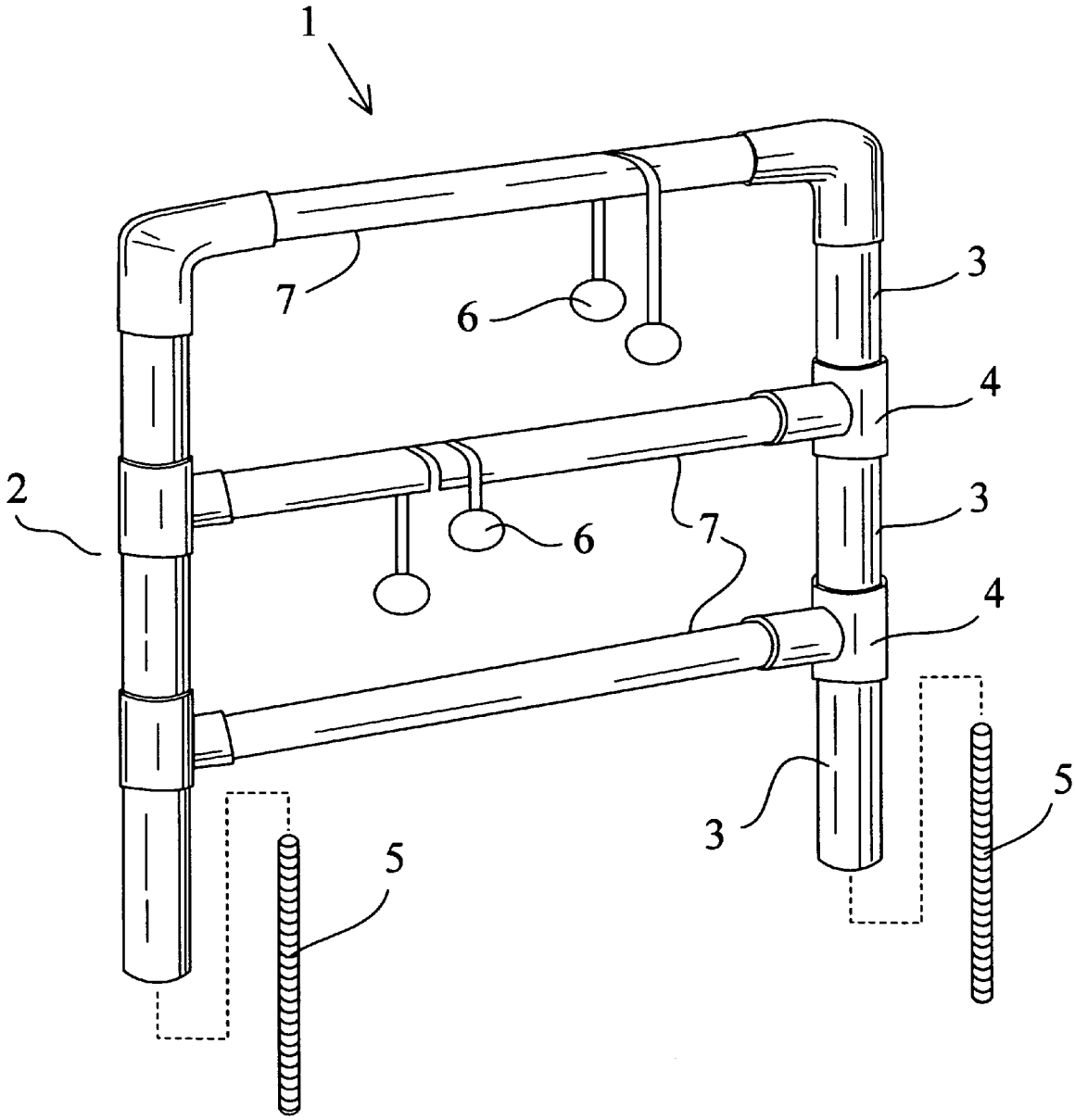
FIG. 1 presents a perspective view of one embodiment of the subjective disclosures herein.

FIG. 1 depicts a perspective view of one embodiment of the subjective disclosures herein. Goal post 1 comprises two side rails 2. The side rails comprise multiple elongated tubular sections 3 joined at ends by pipe tees 4. The removable support means comprises a rigid rod 5 having a bottom end for driving into the ground and a top end that is removably insertable over a distance into a bottom of each side rail 2, the rod size and length selected to support the goal post in a vertical position during game play. Tethered ball bolas 6 are shown resting on or entwined around cross bars 7. Points are scored during game play by tossing the bola from a distally displayed facing goal post to the target goal post such that the bola is captured on a crossbar. Point value of the toss is determined by a pre-defined value assigned to the crossbars of the goal post.

Figure 2:
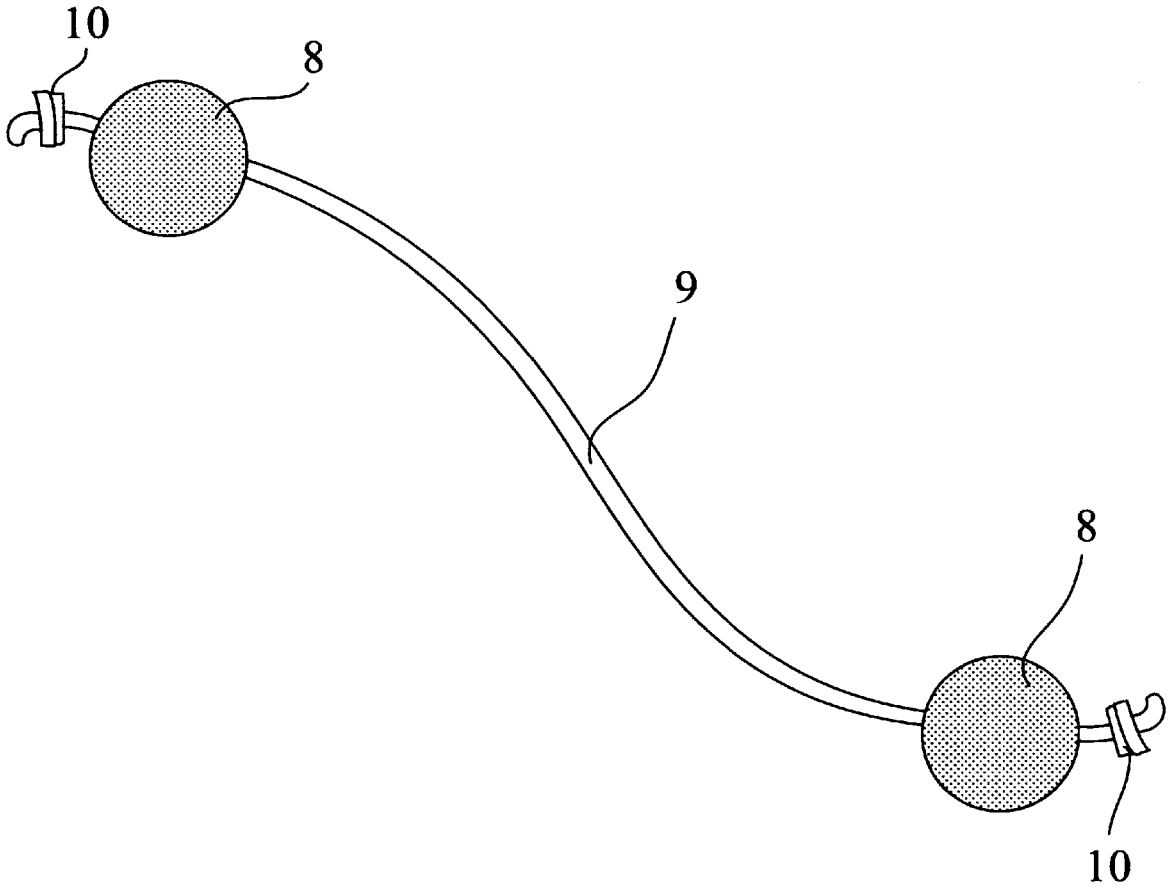
FIG. 2 presents a perspective view of a tethered bar project in accordance with the inventive disclosures herein.

FIG. 2 depicts a perspective view of a tethered bar project in accordance with the inventive disclosures herein. Spherical balls 8 secured to opposite ends of tether cord 9 and retained on the cord by tied knots 10. The invention is not limited to the use of knots to secure the balls to the tether cord, and other means of securing the balls to the cord may be used without deviating from the inventive disclosures herein.

Figure 3:
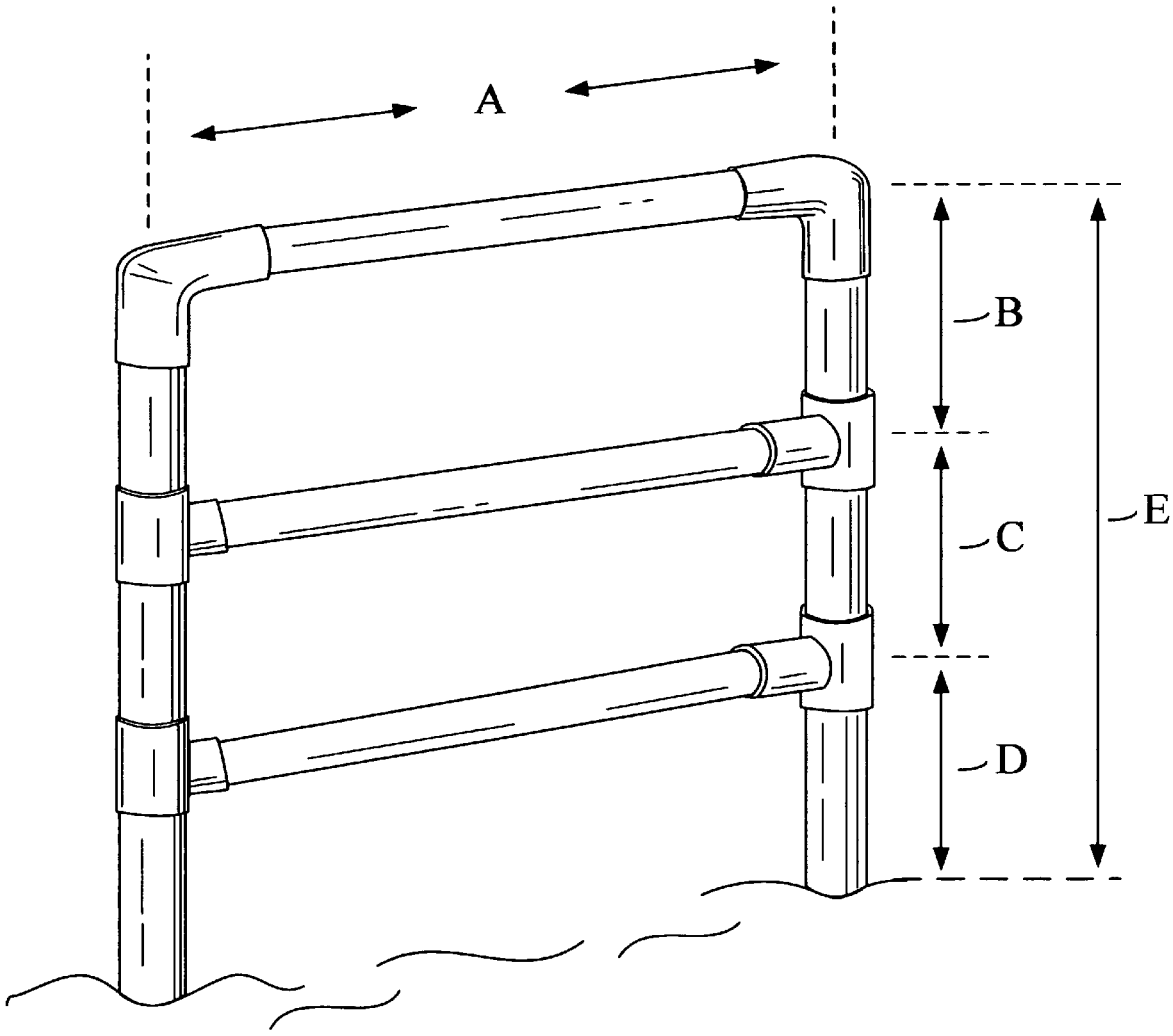
FIG. 3 depicts a goal post having three crossbars for dimensional discussion.

FIG. 3 depicts a goal post having three crossbars. Dimensions are labeled for discussion and identification of preferred embodiments disclosed herein. As envisioned, preferred embodiments of the tethered ball toss and target game of the subject inventive disclosures are provided in at least three adaptations, adapted to differing playing conditions. The differences in the versions will be discussed in detail further below. Our current discussion at this time is limited to dimensional differences in the goal posts as used in three presently envisioned adaptations. Dimensions are depicted in Table 1 which refers to the goal post depicted in FIG. 3.

TABLE 1

| | Dimensions for FIG. 3 in inches | | | | |
|---|---|---|---|---|---|
| | Embodiment | | | | |
| | A | B | C | D | E |
| Junior Bola | 24 | 10 | 10 | 10 | 30 |
| Yard Bola | 32 | 13 | 13 | 13 | 39 |
| Tournament | 32 | 13 | 13 | 13 | 39 |

One adaptation, referred to herein as 'Junior Bola' is adapted to accommodate youth players or for play where playing field space or distance between the distally opposed facing goal posts is confined. In this adaptation the defined distance separating the facing goals posts is between 20 to 25 feet, and the goal post dimensions are as shown in Table 1.

Another adaptation, referred to herein as 'Yard Bola' is adapted for residential yard play, picnic, vacation or park play. In this version the defined distance separating the facing goals posts is between 35 to 40 feet, and the goal post dimensions are as shown in Table 1.

Another adaptation, referred to herein as 'Tournament Bola' is adapted for tournament competitive play. In this adaptation the defined distance separating the facing goals posts is between 35 to 40 feet, and the goal post dimensions are as shown in Table 1.

Other adaptation, dimensions and spacing are envisioned, and it is to be understood that discussed embodiments of the invention are not limited to the adaptations and dimensions disclosed above.

Figure 4:
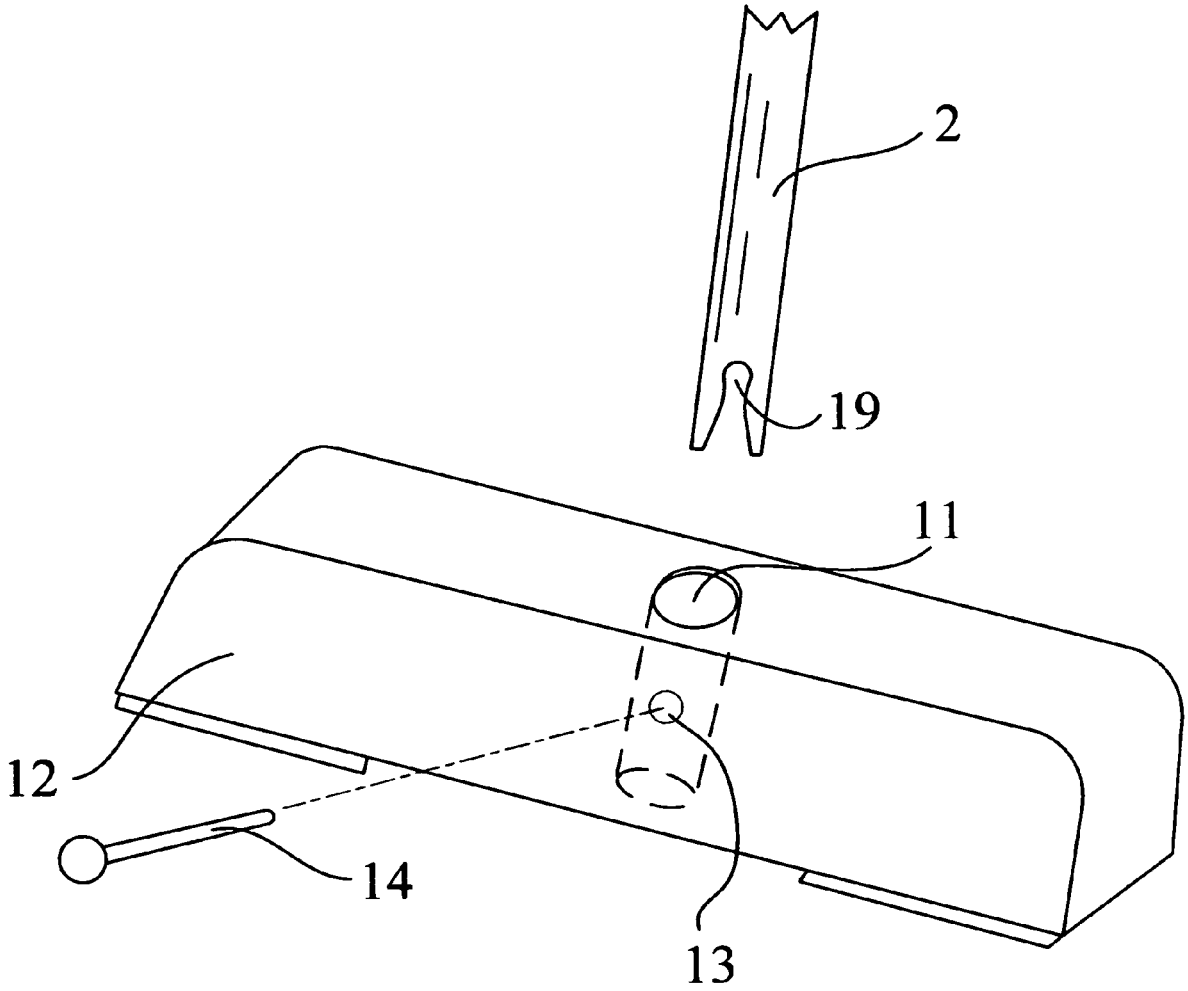
FIG. 4 depicts a goal post support shoe and one means of securing the shoe and maintaining alignment of the shoe to the goal post.

FIG. 4 depicts a goal post support shoe and one means of securing the shoe and maintaining alignment of the shoe to the goal post. Goal post side rail 2 is received into a side rail receiving hole 11 of the support shoe 12. An alignment locking hole 13 is provided through the opposing sides of shoe 12. The alignment locking hole extending directly and linearly through opposing sides of the shoe. A bottom portion of the side rail 2 is provided with an alignment notch 19 which is alignable with the hole in the shoe after the side rail is inserted into the receiving hole in the shoe. An alignment pin 14 is sized and adapted to insert through the hole in the shoe sides and continue through the alignment notch in the side rail such as to maintain alignment of the shoe relative to the goal post.

Figure 5:
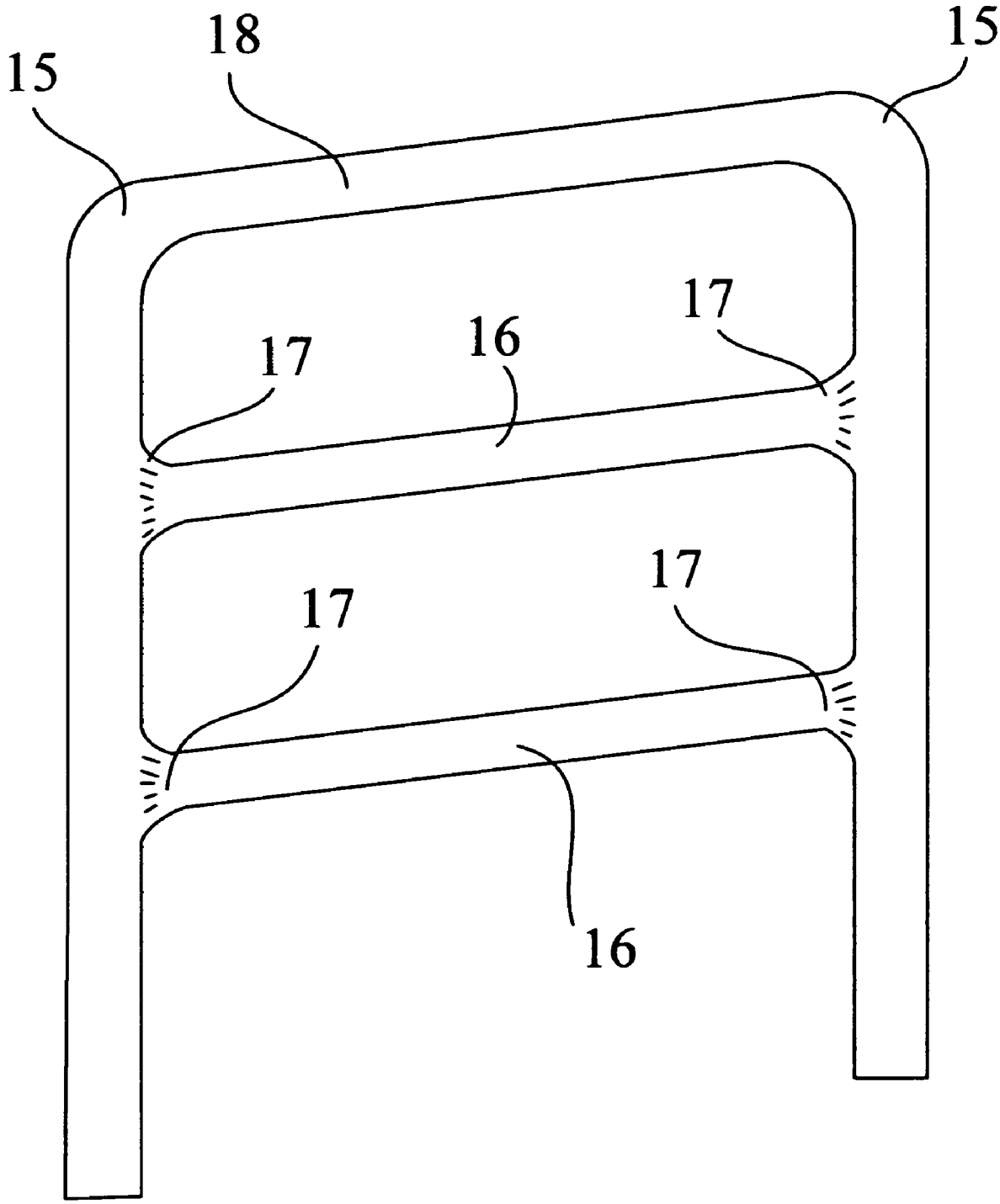
FIG. 5 depicts a goal post constructed of formed and welded metallic sections in accordance with one embodiment of the subjective disclosures herein.

FIG. 5 depicts a goal post constructed of formed and welded metallic sections in accordance with one embodiment of the subjective disclosures herein. The side rails and top cross rail are formed from an elongated tubular metallic piece 18. The tubular metallic piece is formed to provide radius portions 15 on the tubular side rail and top crossbar piece. Middle and lower metallic crossbars 16 are secured to the side rails by welds 17.

The discussion is now directed to more specific embodiments of the tethered ball toss and target game of the subject inventive disclosures. Three embodiments are outlined below, each adapted to differing playing conditions.

In a more specific embodiment of the inventive disclosures herein, the tethered ball toss game is modified to provide a game to accommodate youth players or conditions where playing field space is confined. This embodiment is referred to herein as 'Junior Bola'. In this embodiment each of the two side rails comprise three 9 inch long by ½ inch diameter schedule 40 PVC pipe sections. The three pipe sections of each side rail are joined linearly end to end by ½ inch PVC pipe tees. The top crossbar comprises a 23 inch long by ½ inch diameter schedule 40 PVC pipe having ½ inch PVC elbows secured to each end of the pipe. The opposing end of the elbows of the top rail are secured to the top ends of the side rails. The bottom and middle crossbars comprise 23 inch long by ½ inch diameter schedule 40 PVC pipe. The middle and bottom crossbar opposing ends are secured into the tees of the side rails. The resulting goal post has overall dimensions of nominally 30 inches high by 24 inches wide with 10 inch spacing between the crossbars. In this embodiment the cord comprises 3/16 inch diameter polyester cord and the spherical balls comprise 1.5 oz. medium hard rubber balls, each having a diameter between 1.7 to 1.9 inches, the balls spaced apart on the cord by 12.5 inches to 13 inches. The means of supporting the goal posts comprise the support shoes of the earlier disclosed embodiments. The support shoes comprise stock 2 inch by 4 inch planed lumber with a 2 inch side as the bottom face. The length of the support shoe is nominally 18 inches.

The anti-skid pads secured to the bottom of the support shoes comprise ⅛ inch to ¼ inch thick rubber pads. The plurality of bolas consists of two orange colored bolas and two green colored bolas, the colors to identify bolas of opposing players during play. In this embodiment the defined distance separating the goals posts is between 20 to 25 feet.

In another specific embodiment of the inventive disclosures herein, the tethered ball toss game is modified to provide a game which is adapted to residential yard play. This embodiment is referred to herein as 'Yard Bola'. In this embodiment each of the two side rails comprise three 12 inch long ½ inch schedule 40 PVC pipe sections, the three sections joined linearly end to end by ½ inch PVC pipe tees. The top crossbar comprises a 31 inch long ½ inch schedule 40 PVC pipe having ½ inch PVC elbows secured to each end of the pipe, wherein opposing end of the elbows are secured to the top ends of the side rail. The bottom and middle crossbars comprise 31 inch long ½ inch schedule 40 PVC pipe. Opposing end of the middle and bottom crossbars are secured into the tees of the side rails. The goal post having overall dimensions of nominally 39 inches high by 32 inches wide with 13 inch vertical spacing between the crossbars. The tether cord comprises 3/16 inch diameter polyester cord. The spherical balls comprise 1.5 oz. medium hard rubber balls, each ball having a diameter between 1.7 to 1.9 inches. The balls are spaced apart on the cord by 15.5 inches to 16 inches. The goal post support shoes comprise stock 2 inch by 4 inch planed lumber with a 2 inch side as the bottom face. The length of the support shoe is nominally 24 inches. The anti-skid pads secured to the base of the shoe comprise ⅛ inch to ¼ inch thick rubber pads. The plurality of bolas consists of two red colored bolas and two blue colored bolas, the colors to identify bolas of opposing players. The defined distance separating the goals posts is 35 to 40 feet. This embodiment of the game further comprising a removable outdoor support means as an optional replacement to the support shoes, the outdoor support means comprising a plurality of ½ inch diameter rods having a length of nominally 18 inches. Each rod having a bottom end for driving into the ground and a top end removably insertable into bottom of each goal post side rail.

In another specific embodiment of the inventive disclosures herein, the tethered ball toss game is modified to provide a game which is adapted to tournament competitive play. This embodiment is referred to herein as 'Tournament Bola'. In this embodiment each of the two side rails comprise three 11.9 inch long ¾ inch schedule 40 PVC pipe sections, the three sections joined linearly end to end by ¾ inch PVC pipe tees. The top crossbar comprises a 30.9 inch long ¾ inch schedule 40 PVC pipe having ¾ inch PVC elbows secured to each end of the pipe, with opposing ends of the elbows secured to top ends of the side rails. The bottom and middle crossbars comprise 31 inch long ¾ inch schedule 40 PVC pipe with the middle and bottom crossbar having opposing ends secured into the tees of the side rails. The goal post of this embodiment having nominal overall dimensions of 39 inches high by 32 inches wide with 13 inch vertical spacing between the crossbars. The tether cord comprises ¼ inch diameter braided nylon rope. The spherical balls comprise 1.5 oz. medium hard rubber balls with each having a diameter between 1.7 to 1.9 inches. The balls are spaced apart on the cord by between 16 inches to 16.5 inches. The goal post support shoes comprise stock 2 inch by 4 inch planed lumber with a 2 inch side as the bottom face. The length of the support shoe is nominally 24 inches. The anti-skid pads comprise ⅛ inch to ¼ inch thick rubber pads secured to the bottom of the support shoes. The plurality of bolas consists of three yellow colored bolas and three safety purple colored bolas, wherein the colors are used to identify bolas of opposing players. The prescribed distance separating the goals posts is 35 to 40 feet. This embodiment of the game further comprising a removable outdoor support means as an optional replacement to the support shoes. The outdoor support means comprises a plurality of ¾ inch diameter rods having a length of nominally 16 inches; each rod having a bottom end for driving into the ground and a top end removably insertable into bottom of each side rail.

Figure 6:
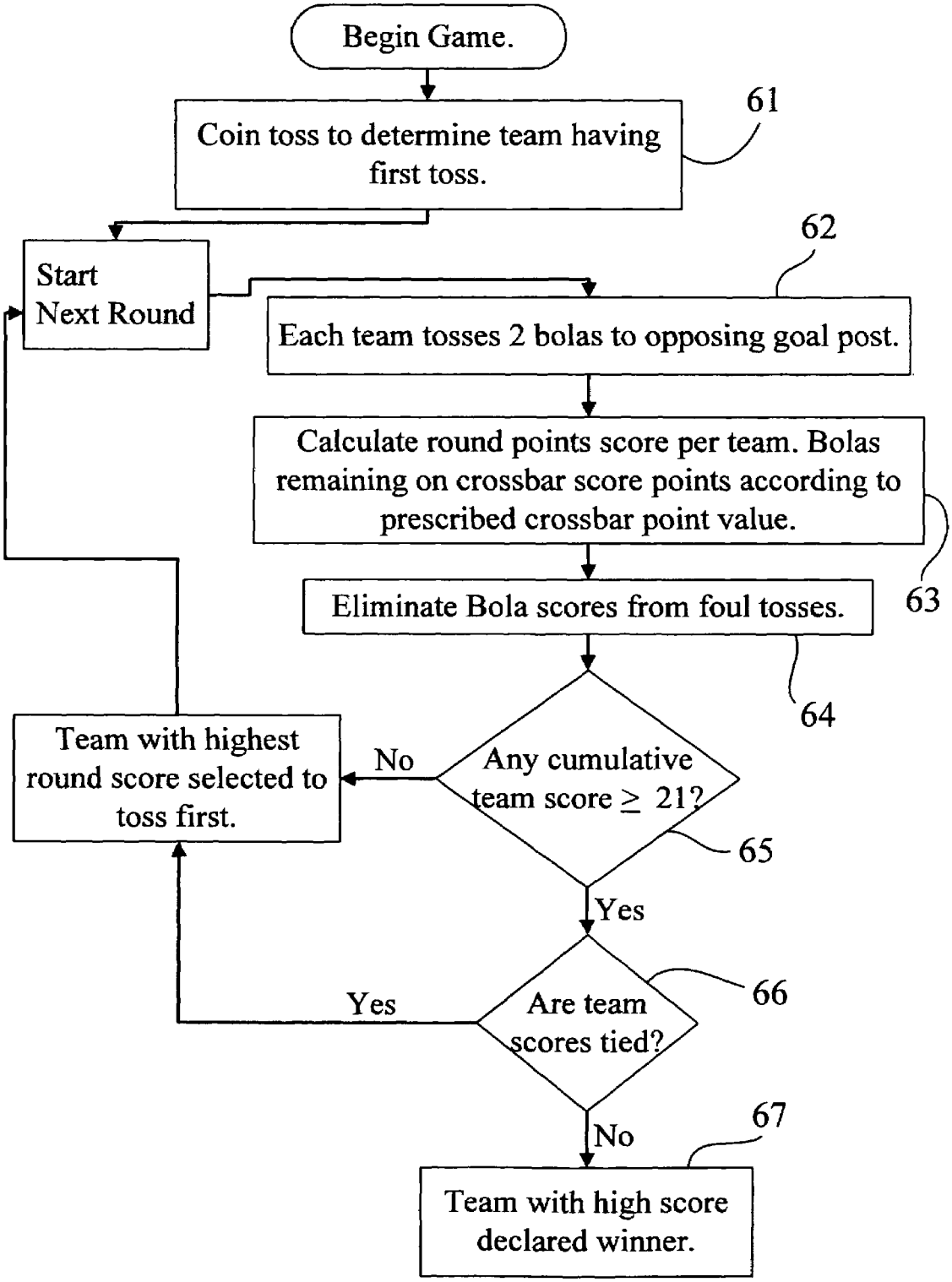
FIG. 6. depicts a flow chart of a method of play for one embodiment of the subjective disclosures herein.

FIG. 6. depicts a flow chart of a method of play for one embodiment of the subjective disclosures herein. The first round of the game is initiated by a coin toss 61 to determine which team plays first. In a round each team 62 tosses two bolas to the opposing goal post. In the case of singles, teams are one player each and each player tosses towards the same goal post. In the case of doubles there is a team of two players at each goal post and the teams in turn toss the bolas at opposing goal posts. After the bolas are tossed, the points scored by each team in the round are totaled 63 and any points scores which occurred from a foul toss are eliminated or dropped 64. The cumulative team scores 65 for all rounds are compared against a target of twenty-one points. If no team has scored twenty-one points thus far then the next round is started. If at least one team has reached twenty-one points, and the teams are tied 66 with the same score, then another round is started to break the tie. If one team has reached twenty-one points and a tie does not exist 67, then the team with the high score is declared the winner and the game ends.

Figure 7:
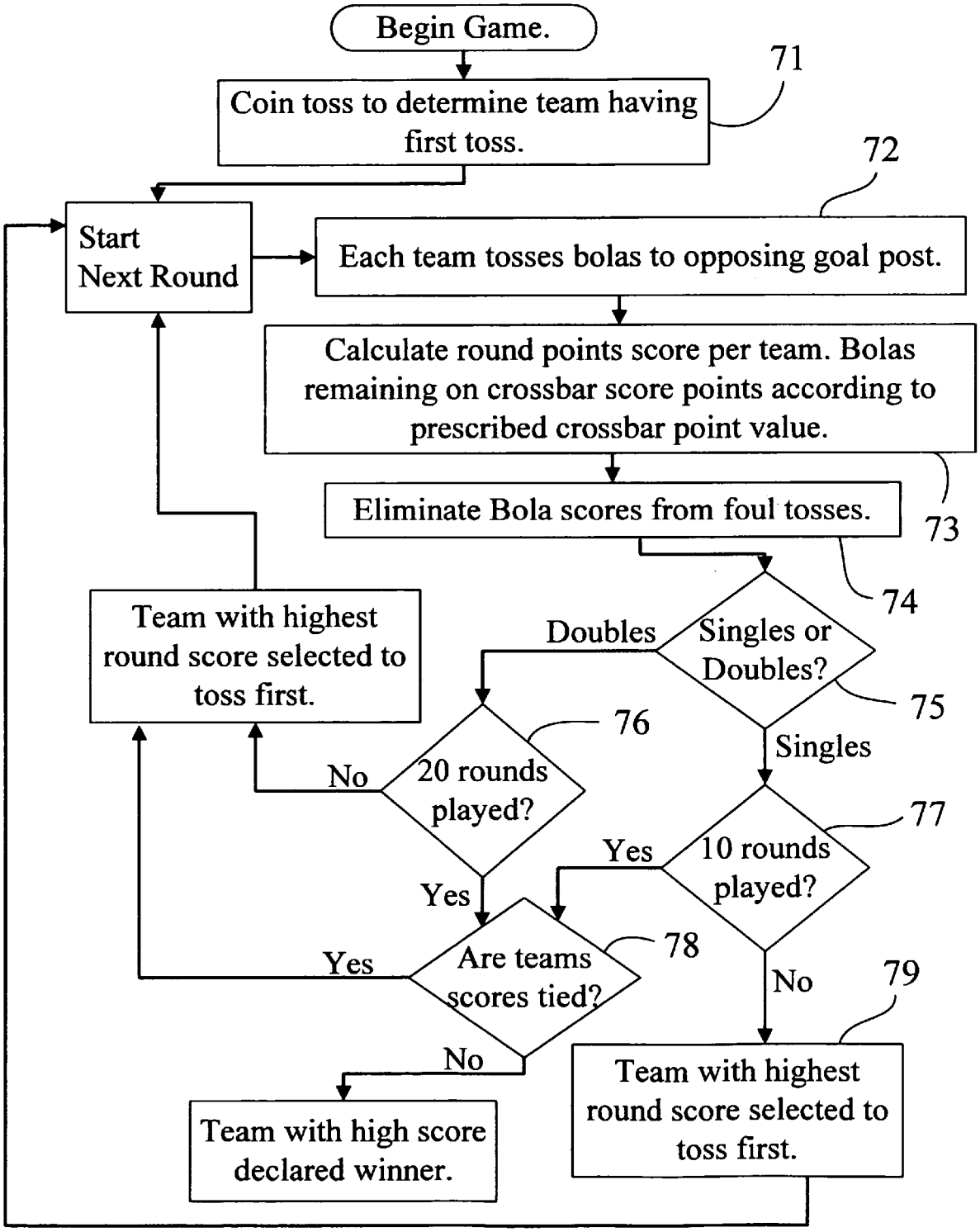
FIG. 7. depicts a flow chart of a method of tournament play for one embodiment of the subjective disclosures herein.

FIG. 7 depicts a flow chart of a method of tournament play for one embodiment of the subjective disclosures herein.

The first round of the game is initiated by a coin toss 71 to determine which team plays first. In a round each team 72 tosses bolas to the opposing goal post. In the case of singles, teams are one player each and each player tosses towards the same goal post. In the case of doubles there is a team of two players at each goal post and the teams in turn toss the bolas at opposing goal posts. After the bolas are tossed, the points scored by each team in the round are totaled 73 and any points scores which occurred from a foul toss are eliminated or dropped 74. If this is singles play 75 and less than ten rounds have been played 76, then the team with the highest score is selected to toss first and a new round is started. If this is doubles play and less than twenty rounds have been played, then the team with the highest score is selected to toss first and a new round is started. If ten rounds have been played in singles play or twenty rounds have been played in doubles play, then if the teams scores are tied 78, a new round is started to break the tie; otherwise the team with the high score is declared the winner 79 and the game ends.

The discussed construction, illustrations and sequence of operation is for specific embodiments of the invention, but is in no way limiting to other embodiments. The operating modes may be changed and enhanced without deviating from the intention of this inventive disclosure.

In the preceding detailed description, reference has been made to the accompanying drawings that form a part hereof, and in which are shown by way of illustration specific embodiments in which the invention may be practiced. These embodiments and certain variants thereof have been described in sufficient detail to enable those skilled in the art to practice the invention. It is to be understood that other suitable embodiments may be utilized and that logical, material, and mechanical changes may be made without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A projectile toss and target game comprising: two substantially vertical goals posts serving as targets, the goal posts spaced apart on a playing field by a defined distance, each goal post comprising: a plurality of vertical distally spaced side rails, two of the side rails forming the side edges of the goal post; and a plurality of crossbars extending between and side rails, the cross bars substantially horizontal, cross bars arranged in a vertically spaced relationship, opposing ends of the crossbars secured to the goal posts; a plurality of tethered projectiles for tossing towards and entangling around the goal posts, each projectile comprising: a flexible cord having two ends; and two spherical balls, each ball secured at opposing ends of the cord, the cord and two spheres forming a bola; and a removable support means for holding the goal posting in a vertical position; wherein the game is played by one or more players or team of players, wherein the game is played in rounds, wherein each player tosses one or more tethered projectiles towards the target in a round with a goal of hanging or wrapping the tethered projectiles on a crossbar, wherein each crossbar is assigned a point score, wherein the player scores points according to the crossbar entwined by the projectile in the toss, wherein game play proceeds until a defined number high score is reached or until a defined number of rounds have taken place, wherein the side rails consist of tubular side rails having a notch through sidewalls at a bottom portion of the side rail; and the removable support means comprises: an elongated goal post support shoe having a side rail receiving hole on a top face of the shoe and an alignment locking hole on a side of the shoe, the hole extending directly and linearly through opposing sides of the shoe, the alignment locking hole through support shoe sides, the alignment locking hole in the shoe positioned to be alignable with the notch in the bottom portion of the sidewall when the side rail is installed into the sidewall receiving hole in the support shoe, length of the support shoe selected to support the goal post in a vertical position during game play each; an alignment locking pin, the pin sized and fitted to be removably received through the alignment locking hole and notch; and one or more anti-skid rubber pads secured to a bottom face of each shoe.

2. The projectile toss and target game of claim 1, wherein: each goal post has two vertical side rails; each goal post has three crossbars consisting of a top, middle and bottom crossbar; and the side rails and crossbar are substantially coplanar, wherein the goal post forms a ladder-like structure.

3. The projectile toss and target game of claim 2, wherein the side rails and top cross bar of the goal post are formed from an elongated metallic tubular member bent into a 'U' shape, the 'U' shaped tubular member forming the side rails and top cross bar of the goal post; and wherein remaining cross bars are metallic and are secured to the side rails by a welding process.

4. The projectile toss and target game of claim 2, wherein each side rail comprises three 9 inch long ½ inch schedule 40 PVC pipe sections, the three sections joined linearly end to end by ½ inch PVC pipe tees; the top crossbar comprises a 23 inch long ½ inch schedule 40 PVC pipe having ½ inch PVC elbows secured to each end of the pipe, opposing end of the elbows secured to top ends of the side rails; wherein the bottom and middle crossbars comprise 23 inch long ½ inch schedule 40 PVC pipe, the middle and bottom crossbar opposing ends secured into the tees of the side rails, such that the goal post has nominal dimensions of 30 inches high by 24 inches wide with 10 inch spacing between the crossbars; the cord comprises 3/16 inch diameter polyester cord; the spherical balls comprise 1.5 oz. medium hard rubber balls, each having a diameter between 1.7 to 1.9 inches, the balls spaced apart on the cord by 12.5 inches to 13 inches; the support shoes comprise stock 2 inch by 4 inch planed lumber with a 2 inch side as the bottom face; the length of the support shoe is nominally 18 inches; the anti-skid pads comprise ⅛ inch to ¼ inch thick rubber pads; the plurality of bolas consists of two orange colored bolas and two green colored bolas, the colors to identify bolas of opposing players; and the defined distance separating the goals posts is between 20 to 25 feet, whereby the game is adapted to accommodate young players or for use where playing field space is limited.

5. The projectile toss and target game of claim 2, wherein each side rail comprises three 12 inch long ½ inch schedule 40 PVC pipe sections, the three sections joined linearly end to end by ½ inch PVC pipe tees; the top crossbar comprises a 31 inch long ½ inch schedule 40 PVC pipe having ½ inch PVC elbows secured to each end of the pipe, opposing end of the elbows secured to top ends of the side rails; wherein the bottom and middle crossbars comprise 31 inch long ½ inch schedule 40 PVC pipe, the middle and bottom crossbar opposing ends secured into the tees of the side rails, such that the goal post has nominal dimensions of 39 inches high by 32 inches wide with 13 inch spacing between the crossbars; the cord comprises 3/16 inch diameter polyester cord; the spherical balls comprise 1.5 oz. medium hard rubber balls, each having a diameter between 1.7 to 1.9 inches, the balls spaced apart on the cord by 15.5 inches to 16 inches; the support shoes comprise stock 2 inch by 4 inch planed lumber with a 2 inch side as the bottom face; the length of the support shoe is nominally 24 inches; the anti-skid pads comprise ⅛ inch to ¼ inch thick rubber pads; the plurality of bolas consists of two red colored bolas and two blue colored bolas, the colors to identify bolas of opposing players; and the defined distance separating the goals posts is 35 to 40 feet.

6. The projectile toss and target game of claim 2, wherein each side rail comprises three 11.9 inch long ¾ inch schedule 40 PVC pipe sections, the three sections joined linearly end to end by ¾ inch PVC pipe tees; the top crossbar comprises a 30.9 inch long ¾ inch schedule 40 PVC pipe having ¾ inch PVC elbows secured to each end of the pipe, opposing end of the elbows secured to top ends of the side rails; wherein the bottom and middle crossbars comprise 31 inch long ¾ inch schedule 40 PVC pipe, the middle and bottom crossbar opposing ends secured into the tees of the side rails, such that the goal post has nominal dimensions of 39 inches high by 32 inches wide with 13 inch spacing between the crossbars; the cord comprises ¼ inch diameter braided nylon rope; the spherical balls comprise 1.5 oz. medium hard rubber balls, each having a diameter between 1.7 to 1.9 inches, the balls spaced apart on the cord by 16 inches to 16.5 inches; the support shoes comprise stock 2 inch by 4 inch planed lumber with a 2 inch side as the bottom face; the length of the support shoe is nominally 24 inches; the anti-skid pads comprise ⅛ inch to ¼ inch thick rubber pads; the plurality of bolas consists of three yellow colored bolas and three safety purple colored bolas, the colors to identify bolas of opposing players; and the defined distance separating the goals posts is 35 to 40 feet.

* * * * *